United States Patent [19]

Black et al.

[11] 4,227,927

[45] Oct. 14, 1980

[54] POWDER METALLURGY

[75] Inventors: Herbert L. Black, Eighty Four; Mark Somerville, Holbrook; Jerome Schwertz, Bethel Park, all of Pa.

[73] Assignee: Cyclops Corporation, Universal-Cyclops Specialty Steel Division, Pittsburgh, Pa.

[21] Appl. No.: 893,276

[22] Filed: Apr. 5, 1978

[51] Int. Cl.[3] ..... B22F 3/14

[52] U.S. Cl. ..... 75/225; 75/200; 75/223; 75/226

[58] Field of Search ..... 75/200, 226, 223, 225

[56] References Cited

U.S. PATENT DOCUMENTS

| | | | |
|---|---|---|---|
| Re. 28,301 | 1/1975 | Havel | 75/223 |
| 3,284,195 | 11/1966 | Googin et al. | 75/223 X |
| 3,419,935 | 1/1969 | Pfeiler et al. | 75/226 X |
| 3,455,682 | 7/1969 | Barburas | 75/223 X |
| 3,700,435 | 10/1972 | Chandhok | 75/223 X |
| 3,704,508 | 12/1972 | Giambattista | 29/420.5 |
| 3,729,971 | 5/1973 | Gurganus et al. | 75/226 |
| 3,862,840 | 1/1975 | Nayar | 75/223 X |
| 3,970,517 | 7/1976 | Van Nederveen | 75/226 X |
| 3,982,934 | 9/1976 | Wentzell | 75/223 |
| 3,992,200 | 11/1976 | Chandhok | 75/226 |
| 4,041,123 | 8/1977 | Lange | 75/226 X |
| 4,081,272 | 3/1978 | Adlerborn | 75/223 |

FOREIGN PATENT DOCUMENTS

| | | | |
|---|---|---|---|
| 2034972 | 1/1972 | Fed. Rep. of Germany | 75/208 R |
| 2035045 | 1/1972 | Fed. Rep. of Germany | 75/208 R |
| 1087400 | 10/1967 | United Kingdom . | |
| 1190123 | 4/1970 | United Kingdom . | |
| 1238166 | 7/1971 | United Kingdom . | |
| 1335489 | 10/1973 | United Kingdom . | |

*Primary Examiner*—Richard E. Schafer

*Attorney, Agent, or Firm*—Webb, Burden, Robinson & Webb

[57] ABSTRACT

A powder metallurgy consolidation process in which the unconsolidated metal powder is placed in a sealable mold; the mold is evacuated and sealed; the mold is placed in an open top container larger than the mold; the space between the mold and container is filled with a free flowing refractory powder, preferably minus twenty mesh powder graphite; and the sealed mold and its contents are heated in the container to metal sintering temperatures without special atmospheres.

8 Claims, No Drawings

POWDER METALLURGY

BACKGROUND

This invention relates to powder metallurgy and particularly to the preparation of substantially fully dense articles by sintering.

U.S. Pat. No. 3,700,435 relates to a hot isostatic pressing process for consolidation of powder metals. In that process, the powder metal is charged to a mold and the mold is placed in a container. The remainder of the container is then filled with a secondary pressure media. The entire assembly is heated and pressurized. The function of the secondary pressure media is to transfer pressure applied to the outer walls of the container to the mold. The interior of the container, including the secondary pressure media, is filled with an inert gas for the heating cycle and evacuated prior to pressing. U.S. Pat. No. 3,700,435 is characteristic of the many hot isostatic pressing processes used for powder metal consolidation all of which require the use of presses and pressure vessels which are extremely expensive.

U.S. Pat. No. 3,704,508 discloses a process for consolidating certain alloys in which no pressing or hot working is necessary. The patent describes pretreating the powder metals with an electron donor compound and subsequently applying heat and vacuum to activate the powder surfaces prior to sintering. The patent describes a method by which high density parts can be produced by sintering metallic powder in a glass mold. These molds must be supported in some manner as the glass becomes relatively fluid at the metal sintering temperatures. Furthermore, the support container must be of the general shape of the glass mold to maintain the shape of the mold and the sintering mass. As this process is applicable to a wide variety of shapes, each requiring a different container configuration, a large number of supporting containers are needed. After placing the glass mold in a support container, usually a carbon container, it is covered with borosilicate glass chips. The glass chips provide support for the compact during sintering, for as the glass softens, it flows over the mold filling the voids and prevents the mold from shifting within the carbon container.

There are several major disadvantages inherent in the process described in U.S. Pat. No. 3,704,508. The most formidable problem, already mentioned, stems from the large number of different glass molds being used. Each mold requires its own carbon or graphite container. It has also been found that the rapid oxidation of the carbon or graphite mold during consolidation at, for example, 2100° F. results in a short life for the container. Protective atmospheres, such as argon or nitrogen, are used to extend the container life. This is helpful since the cost of machining the carbon or graphite containers for complex shapes is very expensive. Even so, with the protective atmosphere, the container life is limited requiring the manufacturer using the process of the aforesaid patent to maintain several spare containers for producing a given shape. Finally, discharging the sintered metal compact from the container and mold is quite difficult due to the flow of glass into the machining marks and other faults in the container.

We have now discovered a substantial improvement in powder metal sintering processes such as those disclosed in U.S. Pat. No. 3,704,508. It is no longer necessary to make expensive carbon or graphite containers and to protect them during sintering with a protective atmosphere and then to discard them anyway due to change of shape resulting from oxidation after several uses. It is an advantage according to this invention that containers machined to near the shape of the glass mold are not required nor is it necessary to use graphite containers at all. It is an advantage according to this invention that heat can be transferred to the glass mold containing the powder to be consolidated, at a substantially uniform temperature over the entire surface of the glass mold. It is yet another advantage that no special atmospheres are required for the practice of this invention nor is expensive hot isostatic pressing equipment required.

SUMMARY OF THE INVENTION

Briefly, according to this invention, a process for consolidating powder metal into a dense article comprises a first step of placing unconsolidated powder metal, preferably treated with a surface activating compound, in a sealable mold which becomes plastic upon heating. A second step comprises evacuating the atmosphere from the powder filled mold with or without heating the powder or the mold. A third step comprises sealing the mold while under vacuum created by evacuating the atmosphere. A fourth step comprises placing the mold in a refractory open top container leaving a space between the mold and the container and filling the space with a free flowing refractory powder, preferably minus twenty mesh (U.S. Standard Sieve Series) powder graphite. A fifth step comprises raising the mold and the powder to a temperature at which sintering of the metal powder takes place, but at which temperature the refractory powder remains free flowing. The temperature is maintained for a time sufficient to cause substantially complete densification of the metal powder, that is, the compact approached theoretical density. A final step comprises cooling and removing the mold from the powder filled container to recover a dense compact which may thereafter be treated in normal metal working processes.

DESCRIPTION OF PREFERRED EMBODIMENTS

In a preferred process, unconsolidated tool steel powder was sized to pass 100 mesh (U.S. Standard Sieve Series) prior to placing in a glass mold into which it was tamped to a density of about 65 volume percent. The powder metal had the following analysis:

| | Weight percent |
|---|---|
| C | 1.00 |
| Mo | 8.50 |
| W | 1.75 |
| Cr | 3.75 |
| V | 1.85 |
| Fe | remainder |

Thereafter, the glass mold was evacuated at room temperature to a pressure of one micron of mercury. The glass mold was placed into a container being a clay-graphite refractory crucible and was packed with refractory powder. Clay-graphite refractories are fired refractory bodies made from a batch comprising fireclay and graphite, fired under conditions to minimize the oxidation of the graphite while promoting a sintering of the clay. Fireclay or other refractory crucibles may be used in this invention as the container for the glass mold and packing. However, since the glass mold does not come into contact with the crucible, the clay-graphite crucible is preferred due to its heat transfer properties and resistance to thermal stock compared to glass.

The refractory powder used was "Mexican" graphite which is an inexpensive minus twenty mesh powder containing at least 88% carbon.

Other refractory powders and mixtures thereof may be used if they have a tendency to freely flow under their own weight as does graphite powder which flows almost like a liquid. It is preferred that the refractory powder or mixture of powders comprise at least fifty percent by volume carbon powder. As used herein carbon powder means powdered carbon or graphite including, for example, flaked graphite, carbon black, pulverized coal, coke or charcoal, and petroleum residues. Other suitable refractory powders comprise silicon carbide, tungsten carbide, and other powders which are available as a by-product dust from various processes.

The mold used in this particular example was pyrex glass. Other glasses are suitable and indeed, the principle requirement of the molds is that they be nonreactive with the powder metal during sintering and at the same time that they become plastic at sintering temperatures. Hence, various glasses are appropriate to this process.

The pyrex mold and the clay-graphite container packed with powdered graphite were heated to 2200° F. for 16 hours, after which the mold was cooled and broken away from a consolidated metal shape having near theoretical density.

The foregoing described process has all the advantages of the system of the prior art and eliminates many of the disadvantages. Support for the mold is available throughout the sintering cycle. As the compact consolidates, the free flowing graphite shifts to compensate for the shrinkage. No extra glass is needed to protect the compact. Heat transfer is good. The clay-graphite crucible has a high emissivity as does the graphite powder which is exposed at the top. Although the graphite powder conductivity is not especially high, a phenomena occurs during consolidation that improves the heating rate considerably. As the graphite begins to heat up, oxidation takes place and a churning of the bed similar to that in a gas fluidized particle bed takes place. This "boil" increases the heat transfer rate such that the temperature of graphite and mold lags only slightly behind the furnace temperature. The movement of the graphite bed provides uniform heating of the mold.

The versatility of this process permits the use of a single size crucible for a wide variety of glass molds, irrespective of their size and shape. The life of the crucibles is good. No special atmosphere is needed and only about a 10% graphite loss is experienced. That is, after removal of a slight slag cap, the remaining graphite is reusable. Discharge of the sintered compact is quite simple as the glass does not adhere to the clay-graphite crucible or the graphite.

By way of comparison, a plain carbon steel container was constructed. A glass mold filled and sealed substantially as described above was placed in the steel container and the container was filled with powdered graphite packed around the mold. The graphite and steel reacted rapidly causing severe deterioration of the container and the part consolidated was only of average quality.

Still by way of comparison, a refractory clay-graphite crucible was used as a container and after a mold filled and sealed substantially as described above was placed in the container, ground glass was packed about the mold. Considerable glass-crucible reaction occurred and the workpiece or compact simply did not consolidate.

It should be understood that the foregoing process is applicable to consolidation of numerous powder metals and alloys by sintering at temperatures and for periods appropriate to each. The process is not limited in applicability to the tool steel set forth above.

Having thus described our invention in detail and with the particularity required by the Patent Laws, what is desired protected by Letters Patent is set forth in the following claims.

We claim:

1. A process for consolidating powder metals comprising the steps for (a) placing unconsolidated powder metal in a sealable glass mold which becomes plastic upon heating, (b) evacuating the atmosphere from the powder filled mold, (c) sealing the mold, (d) placing the mold in an open top refractory container and packing with free flowing refractory powder selected to freely flow at all the temperatures encountered in the process, (e) heating the mold and contents of the mold to a temperature at which sintering of the powder metal takes place and holding at this temperature for a time sufficient to cause substantially complete densification of the powder metal, (f) cooling and removing the mold to recover a dense article, and whereby the glass mold is supported by the free flowing refractory powder as the mold becomes plastic and shrinks in volume as its contents densify.

2. The process according to claim 1 wherein the refractory powder is selected to be substantially nonreactive with the container and mold.

3. The process according to claim 1 wherein the refractory powder is at least 50 volume percent carbon powder.

4. The process according to claim 1 in which the refractory powder comprises at least 50 volume percent selected from the group comprising powder graphite, coal dust, flake graphite, carbon black and mixtures thereof.

5. The process according to claim 1 wherein the refractory container is a clay-graphite crucible.

6. The process according to claim 1 wherein the refractory container is selected to be substantially nonreactive with the mold.

7. A process for consolidating powder metals comprising the steps for (a) placing the unconsolidated powder metal in a sealable glass mold, (b) evacuating the atmosphere from the powder filled mold, (c) sealing the mold, (d) placing the mold in an open top clay-graphite crucible and packing with a refractory powder comprising at least 50 volume percent carbon minus twenty mesh U.S. Sieve Series powder, (e) heating the mold and contents of the mold to temperatures at which sintering of the powder metal takes place for a time sufficient to cause substantially complete densification of the powder metal, and (f) cooling and removing the mold to recover a dense article.

8. A process according to claim 7 in which the heating step takes place in an oxidizing atmosphere whereby slight oxidation of the carbon powder causes churning of the refractory powder packing.

* * * * *